US011179651B2

(12) United States Patent
Kamiyama

(10) Patent No.: US 11,179,651 B2
(45) Date of Patent: Nov. 23, 2021

(54) MODEL TOY AND COOKING APPLIANCE TOY

(71) Applicant: EPOCH COMPANY, LTD., Tokyo (JP)

(72) Inventor: Kei Kamiyama, Tokyo (JP)

(73) Assignee: EPOCH COMPANY, LTD., Tokyo (JP)

( * ) Notice: Subject to any disclaimer, the term of this patent is extended or adjusted under 35 U.S.C. 154(b) by 0 days.

(21) Appl. No.: 16/892,754

(22) Filed: Jun. 4, 2020

(65) Prior Publication Data

US 2020/0384379 A1 Dec. 10, 2020

(30) Foreign Application Priority Data

Jun. 6, 2019 (JP) ..... JP2019-105820

(51) Int. Cl.
*A63H 33/30* (2006.01)

(52) U.S. Cl.
CPC ..... *A63H 33/3055* (2013.01)

(58) Field of Classification Search
CPC ... A63H 33/003; A63H 33/30; A63H 33/3055
See application file for complete search history.

(56) References Cited

U.S. PATENT DOCUMENTS 1,565,209 A 12/1925 Schwarzenhauer
3,058,259 A * 10/1962 Kripak ..... A63H 33/30 446/397
4,515,359 A 5/1985 Mariol
(Continued)

FOREIGN PATENT DOCUMENTS

CN A-101884504 11/2010
DE 1022508 B 2/1957
(Continued)

OTHER PUBLICATIONS

RU Office Action dated Nov. 9, 2020 from corresponding Russian patent application No. 2020118506 (with attached English-language translation).
(Continued)

*Primary Examiner* — Eugene L Kim
*Assistant Examiner* — Alyssa M Hylinski
(74) *Attorney, Agent, or Firm* — Faegre Drinker Biddle & Reath LLP

(57) ABSTRACT

A model toy includes: a tray support configured to support a supported portion of a tray including first and second opposite placement portions; a housing supporting the tray support rotatably around a first axis and having an opening; a door supported rotatably around a second axis and provided at the opening. The door includes a main body and a regulated portion which are provided at symmetrical positions with respect to the second axis. When the tray support is in an intermediate angle range between a first angle posture and a second angle posture reversed from the first angle posture, at least part of the tray support is located closer to the regulated portion than that in the first and second angle postures such that the tray support regulates an opening operation of the door and supports the door in a closed state.

5 Claims, 8 Drawing Sheets

(56) References Cited

U.S. PATENT DOCUMENTS

| | | | | | |
|---|---|---|---|---|---|
| 4,655,726 | A * | 4/1987 | Brzezinski | A63F 5/04 446/268 |
| 5,160,288 | A * | 11/1992 | Seda | A63H 3/52 108/13 |
| 5,716,253 | A | 2/1998 | Aoki et al. | |
| 6,322,416 | B1 * | 11/2001 | Burke | A63H 33/22 446/175 |
| 8,568,193 | B1 * | 10/2013 | Evans | A63H 33/003 446/424 |
| 10,653,260 | B2 * | 5/2020 | Cirri | A47G 29/1209 |
| 10,888,188 | B2 * | 1/2021 | Cirri | A47G 29/1209 |
| 2009/0075559 | A1 * | 3/2009 | Barthold | A63H 17/26 446/470 |
| 2017/0173489 | A1 | 6/2017 | Akavia et al. | |

FOREIGN PATENT DOCUMENTS

| | | | | |
|---|---|---|---|---|
| DE | 1022948 | B | 3/1957 | |
| EP | 0748643 | A2 | 12/1996 | |
| ES | U-287962 | | 10/1986 | |
| GB | 2349835 | A * | 11/2000 | A63H 33/3055 |
| JP | A-S61-131779 | | 6/1986 | |
| JP | 2005034440 | A * | 2/2005 | |
| JP | 2018-164492 | A | 10/2018 | |
| RU | U1-12983 | | 3/2000 | |

OTHER PUBLICATIONS

Extended European Search Report dated Oct. 13, 2020 in corresponding European patent application 20178315.6 (7 pages).

* cited by examiner

MODEL TOY AND COOKING APPLIANCE TOY

CROSS-REFERENCES TO RELATED APPLICATIONS

This application is based on and claims priority from Japanese Patent Application No. 2019-105820 filed on Jun. 6, 2019, the entire contents of which are incorporated herein by reference.

FIELD

One or more embodiments of the present invention relate to a model toy and a cooking appliance toy.

BACKGROUND

In the related art, a model toy imitating a kitchen utensil has been provided. For example, a toy set disclosed in JP-A-2018-164492 is a simulated oven into which an intermediate material obtained by mixing a base material and an expanding agent can be put. When the intermediate material is produced as dough of the simulated bread and then put into the simulated oven, a thickness of the intermediate material is expanded to about 1.2 times after 20 minutes. Further, JP-A-2018-164492 also describes that the simulated bread is applied with baking-imitating color by applying an oiliness agent after drying.

SUMMARY

However, with the model toy of JP-A-2018-164492, it takes time from the putting of the simulated bread to the end of cooking, and it is difficult to easily enjoy a state change before and after cooking.

An object of one or more embodiments of the present invention is to provide a model toy and a cooking appliance toy which allow easily enjoying of a state change.

In an aspect of the present invention, there is provided a model toy including: a tray support configured to support a supported portion of a tray, the tray including a first placement portion and a second placement portion provided on an opposite side of the first placement portion; a housing which supports the tray support rotatably around a first axis, and which has an opening formed to oppose the tray support in a first axis direction; a door which is supported rotatably around a second axis with respect to the housing, and which is provided at the opening; and an operation unit configured to operate rotation of the tray support, wherein the door includes a main body and a regulated portion which are provided at symmetrical positions with respect to the second axis, and wherein when the tray support is in an intermediate angle range between a first angle posture and a second angle posture reversed from the first angle posture, at least part of the tray support is located closer to the regulated portion than that in the first angle posture and the second posture such that the tray support regulates an opening operation of the door and supports the door in a closed state.

In another aspect of the present invention, there is provided a cooking appliance toy including: a tray support configured to support a supported portion of a tray, the tray including a first placement portion and a second placement portion provided on an opposite side of the first placement portion; a housing which supports the tray support rotatably around a first axis, and which has an opening formed to oppose the tray support in a first axis direction; a door which is supported rotatably around a second axis with respect to the housing, and which is provided at the opening; and an operation unit configured to operate the rotation of the tray support, wherein the door includes a main body and a regulated portion which are provided at symmetrical positions with respect to the second axis, wherein when the tray support is in an intermediate angle range between a first angle posture and a second angle posture reversed from the first angle posture, at least part of the tray support is located closer to the regulated portion than that in the first angle posture and the second posture such that the tray support regulates an opening operation of the door and supports the door in a closed state, and a first figure body before cooking is disposed on the first placement portion, and a second figure body after cooking is disposed on the second placement portion.

According to the above aspects, it is possible to provide a model toy and a cooking appliance toy which allow easily enjoying of the state change.

BRIEF DESCRIPTION OF DRAWINGS

FIG. 1A shows a state in which a door is closed, and FIG. 1B shows a state in which the door is opened.

FIG. 5A shows a first placement portion side, and FIG. 5B shows a second placement portion side.

FIG. 8A shows a state in which the tray support is rotating, and FIG. 8B shows a second angle posture after the rotation of the tray support is finished.

DETAILED DESCRIPTION

Figure 1B:
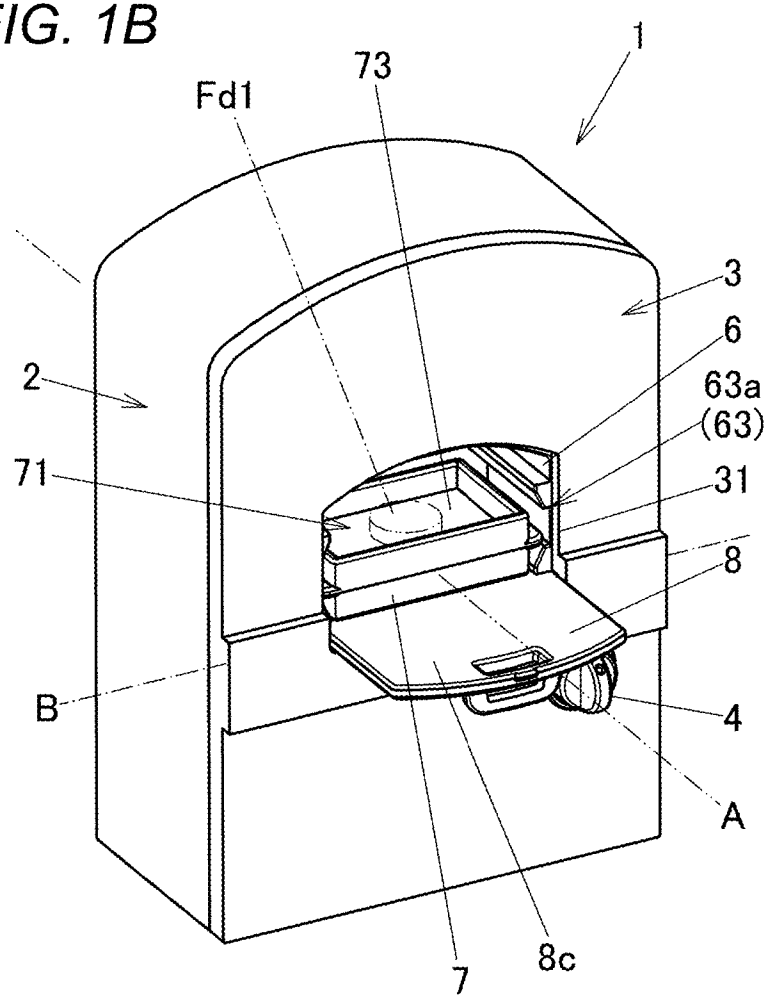
FIGS. 1A and 1B are perspective views of a cooking appliance toy according to an embodiment of the present invention.
Figure 1A:
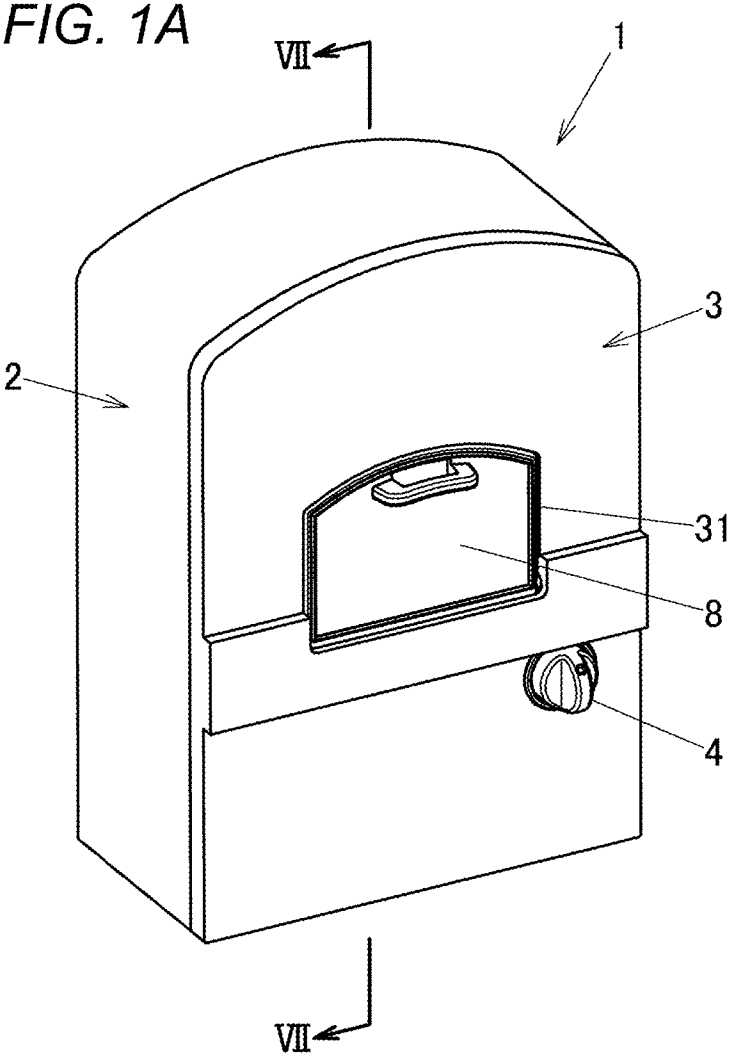

Next, an embodiment of the present invention will be described with reference to the drawings. FIGS. 1A and 1B are perspective views of a cooking appliance toy 1 in states in which a door 8 is closed and the door 8 is opened, respectively. The cooking appliance toy 1 is formed to imitate a kiln. The cooking appliance toy 1 is a toy in which a tray 7 is accommodated therein with a surface (front surface) on which a first figure body Fd1 imitating a food before cooking such as bread and pizza is disposed facing upward, and when an operation unit 4 is rotated after the door 8 is closed, the tray 7 is reversed and an opposite side surface (back surface) on which a second figure body Fd2 simulating the food after cooking is disposed is turned upward, thus simulating and enjoying cooking. In the following description, a door 8 side of the cooking appliance toy 1 is referred to as the front, an opposite side is referred to as the rear, a left side when viewed from the front side of the cooking appliance toy 1 is referred to as the left, and an opposite side is referred to as the right.

The cooking appliance toy 1 is formed in a substantially rectangular parallelepiped shape, and includes a first housing 2 that forms a rear surface, and side surfaces on upper, lower, left and right sides, and a second housing 3 that forms a front surface. An opening 31 is provided in the second housing 3. In the opening 31, a door 8 that can be opened and closed by one side is provided. The door 8 is rotatably supported by a rotation shaft 83 (second axis B) with respect to the second housing 3 at left and right inner edges on a lower end side of the opening 31 (see also FIG. 2).

As shown in FIG. 1B, the tray 7 on which the first figure body Fd1 is placed can be inserted from the front side into the opening 31 and accommodated therein. On a lower right side of the opening 31 of the second housing 3, the operation unit 4 disposed to be rotatable is provided.

Figure 2:
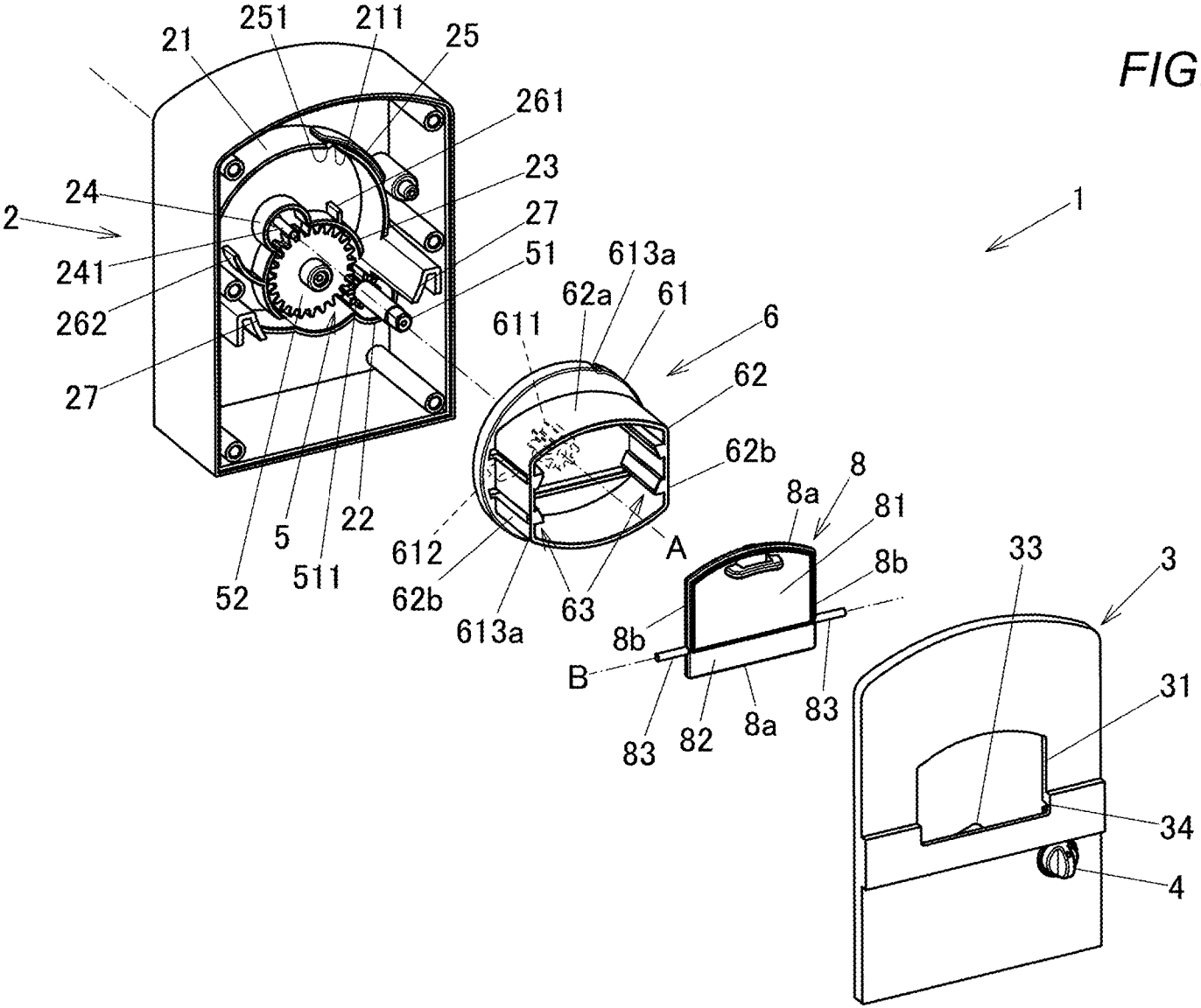
FIG. 2 is an exploded perspective view of the cooking appliance toy according to the embodiment of the present invention as seen from a front side thereof in which a tray is omitted.
Figure 3:
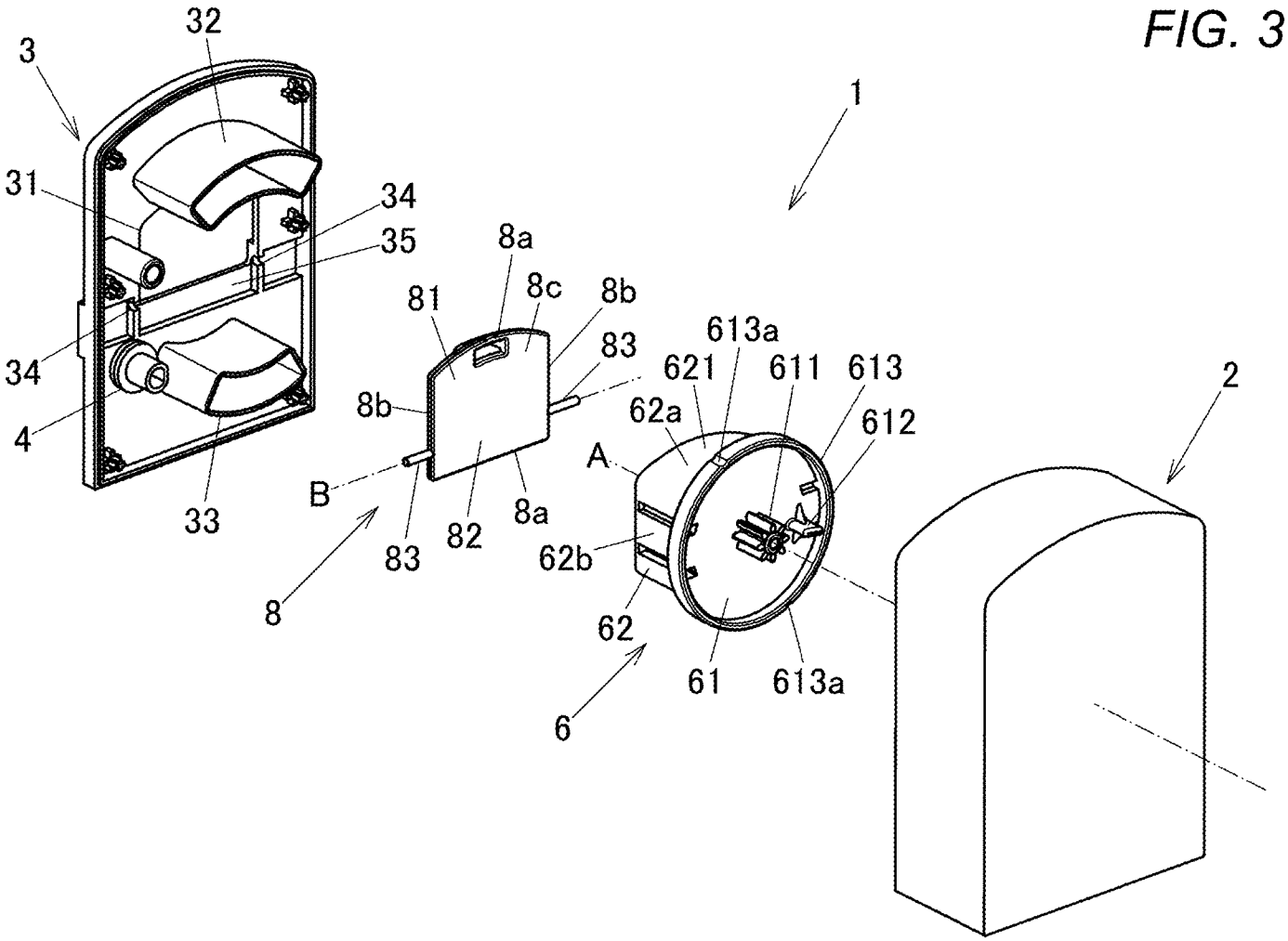
FIG. 3 is an exploded perspective view of the cooking appliance toy according to the embodiment of the present invention as seen from a rear side thereof in which the tray is omitted.

FIGS. 2 and 3 are exploded perspective views of the cooking appliance toy 1 as viewed from the front side and the rear side, respectively. The cooking appliance toy 1 accommodates a transmission mechanism 5 connected to the operation unit 4 and a tray support 6 that can be rotated by the transmission mechanism 5. The tray 7 shown in FIG. 1B can be accommodated inside the tray support 6. The door 8 is provided in the opening 31 formed in the second housing 3 and on a front side of the tray support 6.

Outer frame portions 21, 22 and inner frame portions 23, 24 each formed in a substantially short cylindrical shape are disposed inside the first housing 2. A disk portion 61 of the tray support 6 is accommodated inside the frame portion 21. Spur gears (a drive gear 511, an intermediate gear 52, and a driven gear 611, which are to be described later) are accommodated in the three frame portions 22 to 24. A part of each of side surfaces of the frame portions 22 to 24 corresponding to a meshing position of the spur gears are cut away so as to communicate with each other.

The drive gear 511 of a drive shaft 51 provided in the transmission mechanism 5 and the intermediate gear 52 that meshes with the drive gear 511 are accommodated in the frame portion 22 and the frame portion 23, respectively. The drive gear 511 and the intermediate gear 52 are rotatably supported by shafts (not shown) provided in the respective frame portions 22, 23. Further, the driven gear 611 formed on the tray support 6 is accommodated in the frame portion 24. The driven gear 611 is supported by a shaft 241 provided inside the frame portion 24. Thus, the first housing 2 can support the tray support 6 rotatably around a first axis A that is coaxial with the shaft 241. A front end of the drive shaft 51 is connected to the operation unit 4. Therefore, the drive shaft 51 is rotated by the rotation operation of the operation unit 4.

In the first housing 2, a rotation regulating member 25 fixed in a cantilevered leaf spring shape is provided. The rotation regulating member 25 is formed in an arc shape along an outer surface of the frame portion 21. The frame portion 21 is provided with a cutout portion 211. The rotation regulating member 25 has a protrusion 251 on a cutout portion 211 side at a front end of a free end side. The protrusion 251 can be disposed in the cutout portion 211 and protrude toward an inside of the frame portion 21 (see also FIG. 6).

Further, rotation regulating portions 261, 262 extending from the frame portion 23 are formed between the frame portion 21 and the frame portion 24. Front ends of the rotation regulating portions 261, 262 are disposed at substantially symmetrical positions on a concentric circle around the first axis A.

The second housing 3 is formed in a plate shape and has a substantially rectangular opening 31 on a front side in a direction of the first axis A. As shown in FIG. 3, an upper frame portion 32 and a lower frame portion 33 that are erected rearward from an upper side and a lower side of the opening 31 are formed on a rear side of the second housing 3. The upper frame portion 32 and the lower frame portion 33 each are formed in a concave curved cylindrical shape. A rectangular accommodation portion 35 for accommodating a regulated portion 82 in a state where the door 8 is closed is formed below the opening 31.

The tray support 6 includes the disk portion 61 and a frame portion 62 formed on a front side of the disk portion 61. As shown in FIG. 3, the driven gear 611 and a plate-shaped protrusion 612 are formed on a rear surface of the disk portion 61. A short cylindrical edge portion 613 extending rearward is formed at an outer peripheral edge of the disk portion 61. A recessed portion 613*a* recessed in a concave arc shape is formed at two positions on an outer peripheral surface of the edge portion 613. The recessed portions 613*a* are disposed at line-symmetrical positions with respect to the first axis A (that is, symmetrical positions rotated by 180 degrees with respect to the first axis A).

Figure 4:
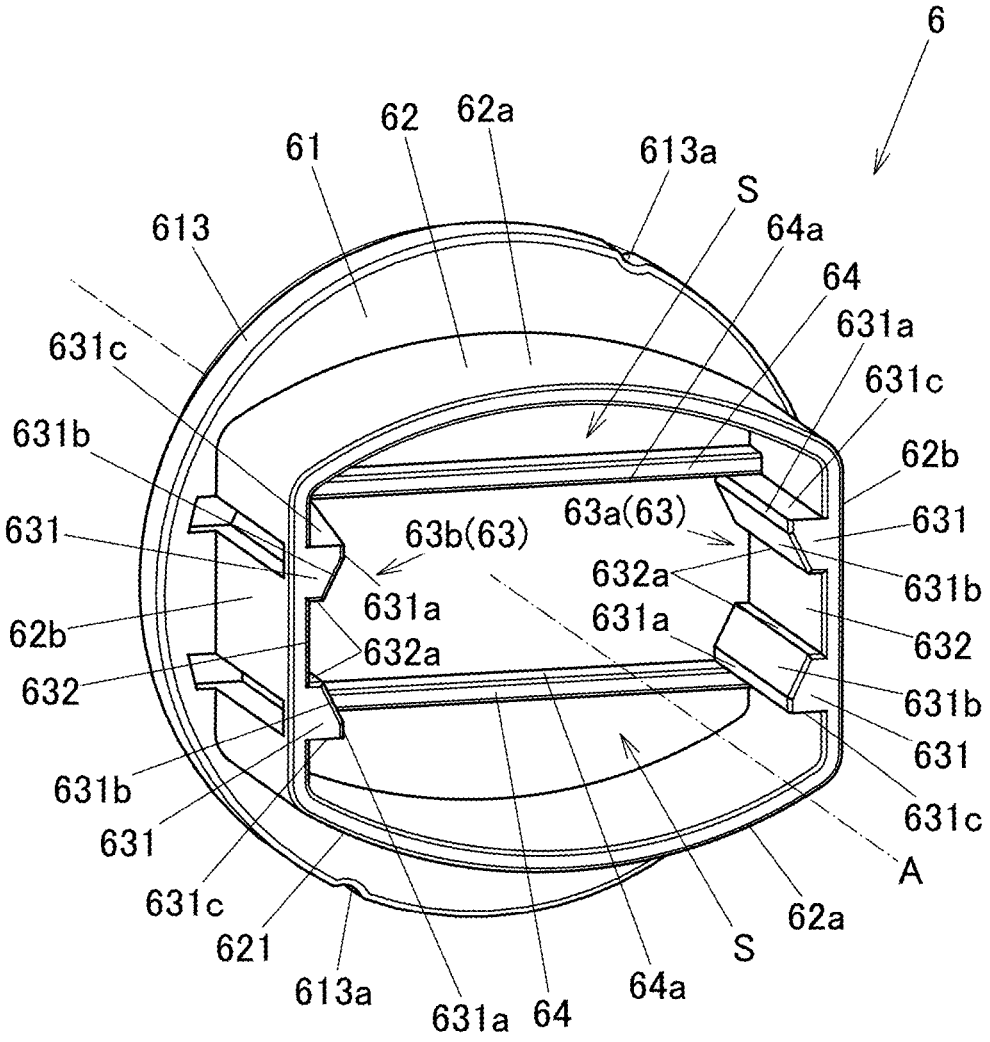
FIG. 4 shows a tray support according to the embodiment of the present invention.

In the tray support 6 shown in FIG. 4, the frame portion 62 is formed in a bottomed substantially rectangular tubular shape with a bottom portion on a disk portion 61 side. Long side surface portions 62*a* located on upper and lower sides of the frame portion 62 are formed in a curved surface shape protruding upward and downward. Support portions 63 (a first support portion 63*a* and a second support portion 63*b*) for supporting the tray 7 is formed to face each other in respective inner surfaces of flat plate-shaped short side surface portions 62*b* located on left and right sides of the frame portion 62. The first support portion 63*a* and the second support portion 63*b* are formed to be line-symmetrical with respect to the first axis A. The first support portion 63*a* and the second support portion 63*b* extend in the direction of the first axis A with substantially the same cross-sectional shape. The first support portion 63*a* and the second support portion 63*b* have groove portions 632, which accommodate supported portions 75 of the tray 7 to be described later, on an inner side in an upper-lower direction in FIG. 4, and have swing regulating protrusions 631 for regulating swing of the tray 7 on both sides of the groove portion 632. The groove portion 632 extends in the direction of the first axis A in a recessed rectangular shape.

The swing regulating protrusions 631 are erected from inner surfaces of the short side surface portions 62*b* toward a first axis A side in a front view of the tray support 6. Similarly to the groove portions 632, the swing regulating protrusions 631 extend in the direction of the first axis A. On both outer sides of the swing regulating protrusion 631, that is, long side surface portion 62*a* sides, open state support portions 631*c* that abut with the door 8 in an open state are formed. Top portions 631*a* of the swing regulating protrusions 631 abut with side surfaces 7*a* of the tray 7 to regulate excessive swing (left-right movement) of the tray 7. An inclined portion 631*b* having a flat surface shape and extending from the top portion 631*a* to the groove portion 632 is formed on the swing regulating protrusion 631.

Flat plate-shaped rear-side support portions 64 extending from the first support portion 63*a* to the second support portion 63*b* are formed inside the frame portion 62. Both ends of the rear-side support portion 64 are adjacent to the swing regulating protrusions 631 on long side surface portion 62*a* sides. Therefore, an inner surface 64*a* of the rear-side support portion 64 on the first axis A side and the open state support portion 631*c* of the swing regulating protrusion 631 are formed in substantially the same plane.

The tray support 6 has spaces S inside the frame portion 62 between the long side surface portions 62*a* and the support portions 63. The space S functions as an escape portion of the regulated portion 82 when the door 8 is opened so as to allow an opening operation of the door 8.

Referring back to FIGS. 2 and 3, the door 8 has a main body 81 and the regulated portion 82, and is formed in a substantially rectangular flat plate shape that is elongated in a left-right direction as a whole. The door 8 has the rotation shaft 83 (second axis B) rotatably supported in the opening 31 of the second housing 3. The main body 81 and the regulated portion 82 are formed at positions symmetric with respect to the second axis B. One of long side edges 8*a* of the door 8 is formed in a curved shape, and the other of the long side edges 8*a* of the door 8 is formed in a linear shape. The rotation shaft 83 is received in shaft receivers 34 of the second housing 3, and a rearward movement is regulated by ribs 27 that are erected from the inside of the first housing 2, and thus the rotation shaft 83 is rotatably supported.

Figure 5A:
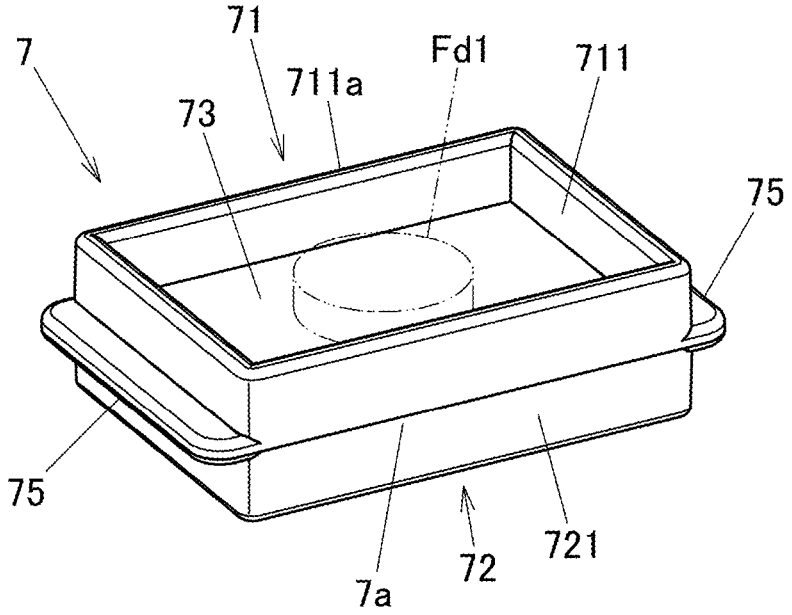
FIGS. 5A and 5B are perspective views of the tray according to the embodiment of the present invention.
Figure 5B:
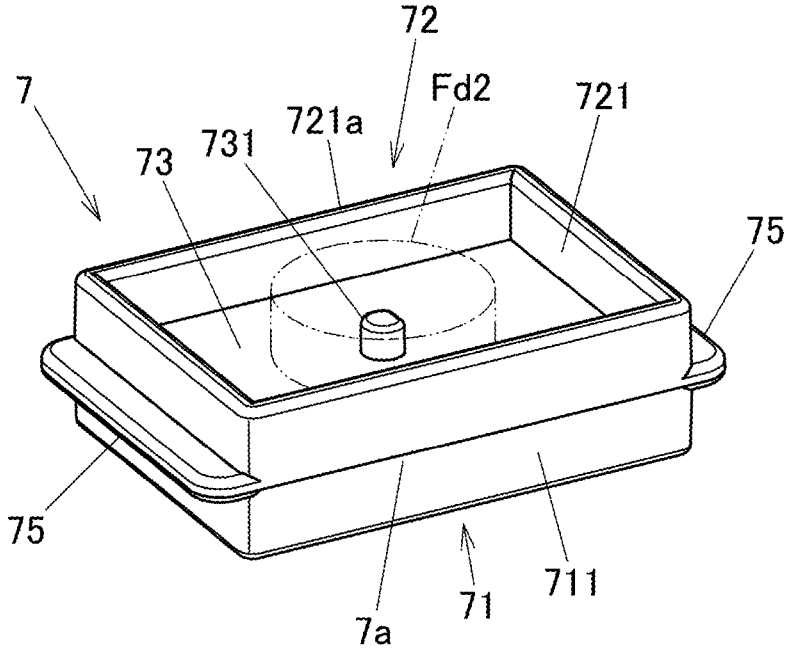

FIGS. 5A and 5B are perspective views of a first placement portion 71 side and a second placement portion 72 side of the tray 7, respectively. The tray 7 includes an elongated rectangular bottom plate 73 and elongated rectangular frame portions 711, 721 that are erected from an outer peripheral edge of the bottom plate 73 to surround the bottom plate 73. The first placement portion 71 and the second placement portion 72 are defined by the bottom plate 73 and the frame portions 711, 721, and are formed in substantially the same shape. A substantially cylindrical engaging protrusion 731 is formed substantially at the center of the bottom plate 73 on the second placement portion 72 side (i.e., a bottom surface of the second placement portion 72). The first figure body Fd1 before cooking (before change) is disposed on the bottom plate 73 on the first placement portion 71 side (i.e., a bottom surface of the first placement portion 71). On the bottom plate 73 on the second placement portion 72 side, the second figure body Fd2 after cooking (after change) is fixed in advance by engaging with the engaging protrusion 731. The second figure body Fd2 can be removed by releasing the engagement. Therefore, a player can select a second figure body Fd2 having a desired shape or the like and fix the second figure body Fd2 on the second placement portion 72 side.

The first figure body Fd1 can be formed by imitating bread before baking, and the second figure body Fd2 can be formed by imitating the bread after baking. For example, the first figure body Fd1 may be set to a bright bread dough color (such as a cream color) before baking and have no pattern. The second figure body Fd2 may be set to a dark color (such as a brown color) after baking and have a pattern. The first figure body Fd1 can be formed smaller than the second figure body Fd2 with a substantially similar shape.

The tray 7 has the supported portions 75 erected from base end portions of the frame portions 711, 721 which are on short sides of the bottom plate 73. The supported portions 75 are formed along a short side direction of the tray 7 so as to be located on substantially the same plane with the bottom plate 73.

Figure 6:
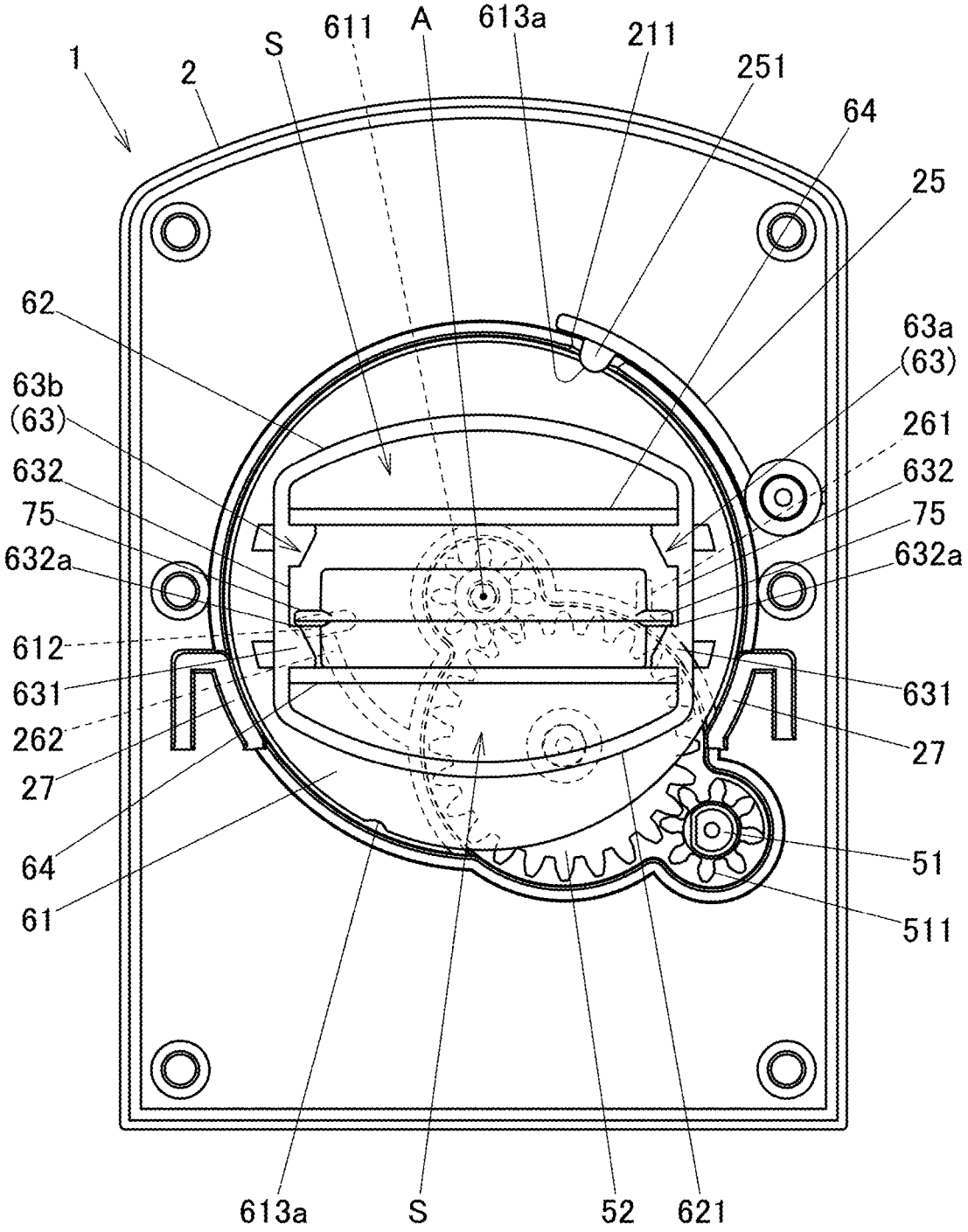
FIG. 6 is a front view showing a state in which a second housing including the door of the cooking appliance toy according to the embodiment of the present invention is removed.
Figure 7:
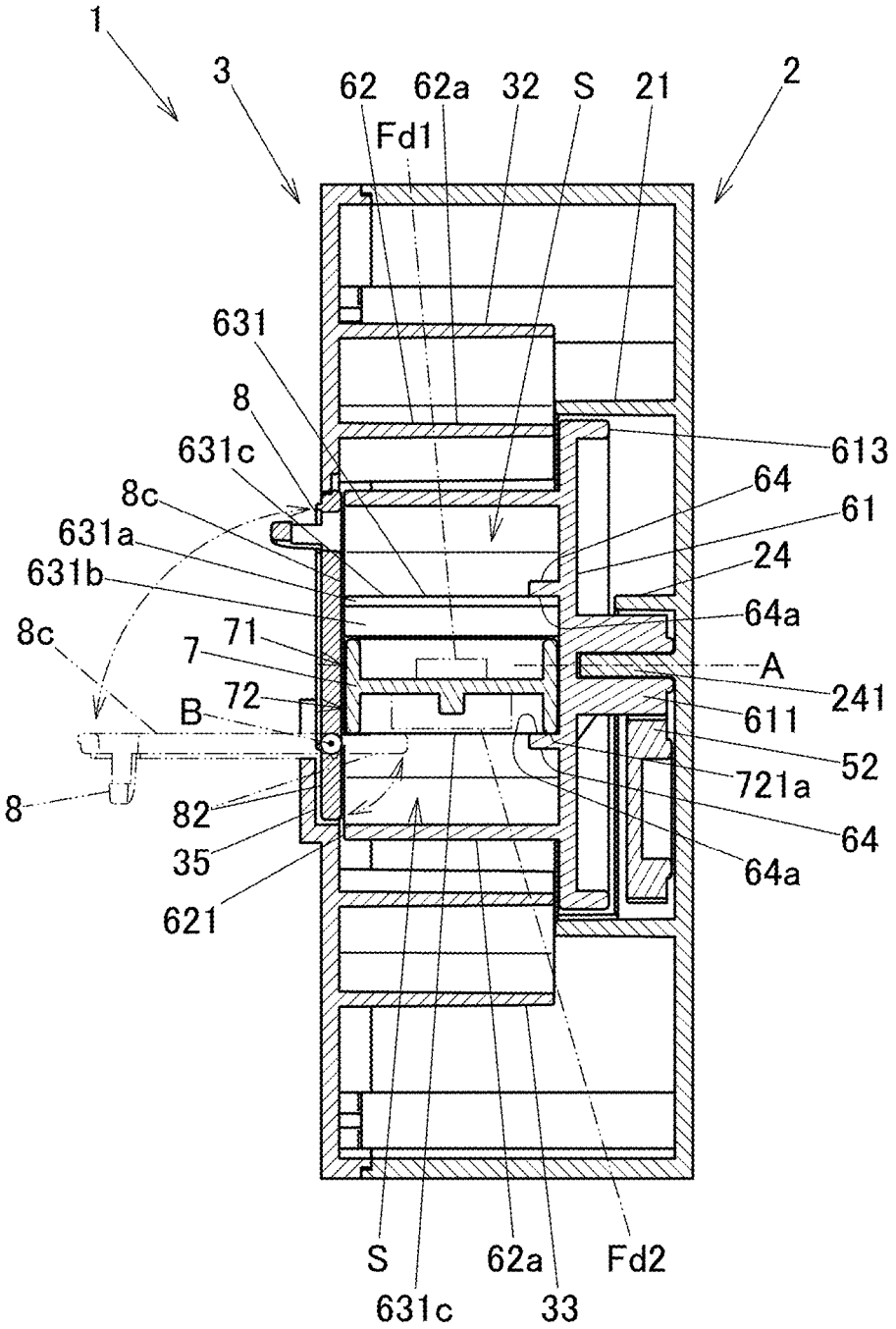
FIG. 7 is a cross-sectional view of the cooking appliance toy according to the embodiment of the present invention taken along a line VII-VII shown in FIG. 1A.

Next, operations of the cooking appliance toy 1 will be described. The tray support 6 shown in FIGS. 6 and 7 are in a state of a first angle posture in which the tray support 6 is positioned at a rotating end in a counterclockwise direction. In the first angle posture, the support portions 63 of the tray support 6 are disposed in the left-right direction substantially parallel to the second axis B (see FIG. 2 and the like).

In the first angle posture, the space S is located behind the second axis B of the door 8 in the left-right direction substantially parallel to the second axis B. Therefore, when the door 8 indicated by a solid line in FIG. 7 is moved in an opening direction, a trajectory of the regulated portion 82 passes through the space S, and rotation of the door 8 is allowed. When the door 8 is moved in the opening direction, the main body 81 of the door 8 rotates toward the opening direction due to own weight, but an opening angle is regulated by abutting between the regulated portion 82 and the open state support portion 631*c*. Further, as indicated by a two-dot chain line, the door 8 is supported in an open state that is substantially 90 degrees open with respect to the opening 31.

When the door 8 is opened at substantially 90 degrees, an inner surface 8*c* of the door 8 is located substantially on the same plane with the inner surface 64*a* of the rear-side support portion 64 and a lower surface of the swing regulating protrusion 631. A length from the supported portion 75 of the tray 7 to an end portion of the first placement portion 71 or the second placement portion 72 (a distal end of the first placement portion 71 or the second placement portion 72) of the tray 7 in a height direction (a direction perpendicular to the bottom plate 73 in the embodiment) is substantially the same as a length from an inner wall 632*a* of the groove portion 632 of the tray support 6 to the open state support portion 631*c* in an upper-lower direction (see FIG. 6). Therefore, by pushing the tray 7 toward an inner side of the opening 31 along the inner surface 8*c* of the opened door 8, the tray 7 can be easily accommodated in the cooking appliance toy 1.

Further, when the tray 7 is accommodated inside the frame portion 62, the supported portions 75 of the tray 7 abut with the inner walls 632*a* on the lower side of the groove portions 632, and as shown in FIG. 7, a rear-side end edge 721*a* of the frame portion 721 on one surface side of the tray 7 (an end edge 711*a* of the frame portion 711 when the tray 7 is turned upside down) abuts on the rear-side support portion 64 on the lower side of the tray support 6. As a result, the tray 7 is stably supported. When the door 8 is closed as indicated by a solid line in FIG. 7, the side surface 7*a* of the tray 7 abuts with the inner surface 8*c* of the door 8, and therefore forward movement of the tray 7 is regulated.

As described above, the player opens the door 8, puts the tray 7 into the cooking appliance toy 1 (tray support 6) from the opening 31 with the first placement portion 71 on which the first figure body Fd1 is placed facing upward, and closes the door 8.

In the first angle posture, rotation of the tray support 6 in the counterclockwise direction is regulated by the protrusion 612 abutting with the rotation regulating portion 262. In the first angle posture, the protrusion 251 of the rotation regulating member 25 engages with one of the recessed portions 613*a* of the tray support 6 via the cutout portion 211. Therefore, free rotation of the tray support 6 in a clockwise direction is regulated by an elastic force of the rotation regulating member 25.

In the first angle posture shown in FIG. 6, when the operation unit 4 is rotated clockwise, the drive gear 511 rotates in the clockwise direction, and the intermediate gear 52 that meshes with the drive gear 511 rotates counterclockwise. The driven gear 611 that meshes with the intermediate gear 52 rotates in the clockwise direction. Therefore, the tray support 6 can rotate around the first axis A in the same direction as the operation unit 4.

Figure 8B:
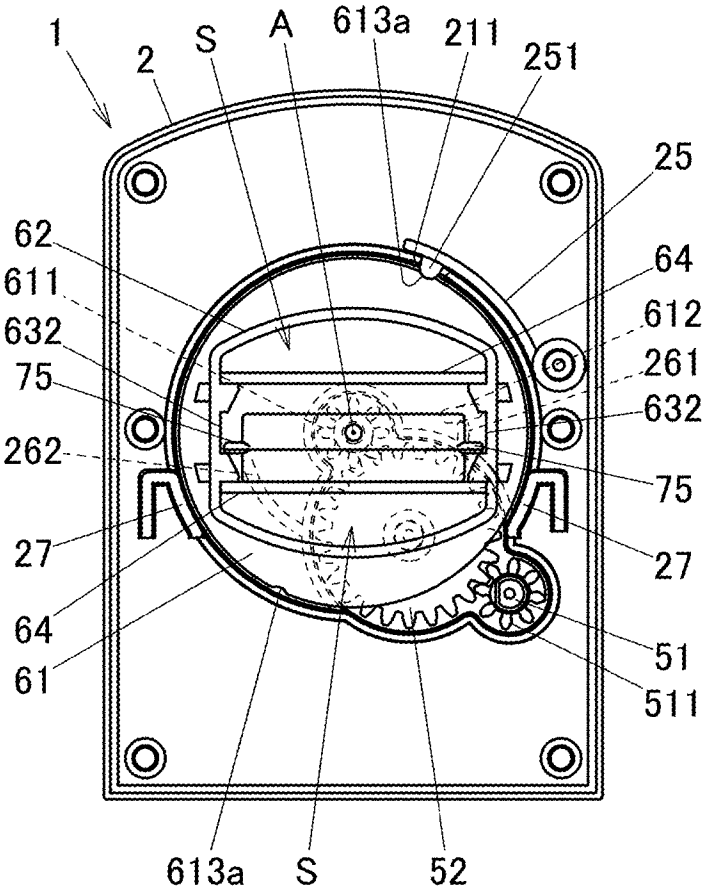
FIGS. 8A and 8B show operations of the cooking appliance toy according to the embodiment of the present invention.
Figure 8A:
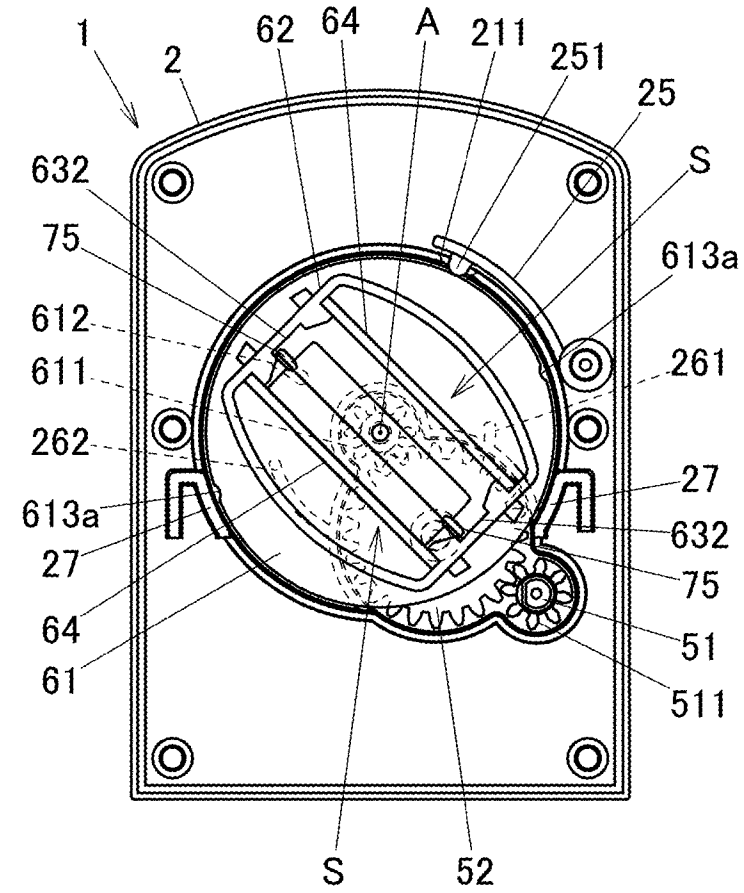

When the rotation of the tray support 6 is started, as shown in FIG. 8A, the protrusion 251 escapes from the recessed portion 613*a* against the elastic force of the rotation regulating member 25, and the tray support 6 rotates. During the rotation of the tray support 6, the protrusion 251 that escapes from the recessed portion 613*a* is in sliding contact with the edge portion 613. The tray 7 accommodated in the support portions 63 is inclined with the rotation of the tray support 6.

In an intermediate angle range between the first angle posture and the second angle posture reversed from the first angle posture, the tray support 6 can regulate the opening operation of the door 8 by being close to the regulated portion 82, so that the door 8 can be supported in the closed state. That is, when the posture of the tray support 6 is in the intermediate angle range, a front edge 621 (see also FIG. 6) of the frame portion 62, which is a part of the tray support 6, is positioned behind the regulated portion 82 in the cross-sectional view of FIG. 7. Therefore, since a part of the tray support 6 is positioned on a rotation trajectory of the regulated portion 82, the rotation of the door 8 is regulated.

As shown in FIG. 8B, the rotation of the tray support 6 in the clockwise direction is regulated by the protrusion 612 abutting with the rotation regulating portion 261. When the tray support 6 is in the second angle posture where the tray support 6 is located at the rotating end in the clockwise direction, the facing first support portion 63*a* and second support portion 63*b* of the tray support 6 are arranged in the left-right direction substantially parallel to the rotation shaft 83 of the door 8. In the second angle posture, the protrusion 251 of the rotation regulating member 25 engages with the other recessed portion 613*a* of the tray support 6 via the cutout portion 211. Therefore, the free rotation of the tray support 6 in the counterclockwise direction is regulated by the elastic force of the rotation regulating member 25. In the second angle posture, the space S is again located behind the regulated portion 82, similarly to the first angle posture. Accordingly, the door 8 is allowed to rotate in the opening direction. Further, the player can easily take out the tray 7 disposed in the opening 31 by opening the door 8 and sliding the tray 7 forward, and can visually recognize the second figure body Fd2 disposed on the second placement portion 72 side of the tray 7. Therefore, it is possible for the player to recognize that the first figure body Fd1 on the tray 7 has been changed to the second figure body Fd2 and the cooking has been completed.

In a case where the first figure body Fd1 is not fixed to the first placement portion 71, the first figure body Fd1 falls on the lower frame portion 33 in the cooking appliance toy 1 by reversing the tray 7. The dropped first figure body Fd1 can be taken out from the opening 31 by taking out the tray 7 first, and then inclining the cooking appliance toy 1.

In a case of playing the cooking appliance toy 1 again, the player places the taken out first figure body Fd1 on the first placement portion 71 of the tray 7, puts the tray 7 in the tray support 6 with the first placement portion 71 facing upward, and closes the door 8. Further, when the posture of the tray support 6 is at the rotating end (second angle posture) in the clockwise direction in the front view as shown in FIG. 8B, the player can rotate the tray 7 in the counterclockwise direction together with the tray support 6 by rotating the operation unit 4 in the counterclockwise direction. Therefore, the first figure body Fd1 placed on the tray 7 can be dropped onto the lower frame portion 33 by reversing the first placement portion 71 to face downward, and the second placement portion 72 to which the second figure body Fd2 is fixed can be positioned upward. Therefore, the player can repeatedly play the game in which the first figure body Fd1 on the tray 7 is changed to the second figure body Fd2.

Similarly to the second figure body Fd2, the first figure body Fd1 may be fixed to the first placement portion 71 of the tray 7 in advance. Accordingly, it is possible to omit the operation of taking out the first figure body Fd1 separately from the tray 7 every time the tray 7 is reversed.

Further, in the description of the present embodiment, the first placement portion 71 of the tray 7 is disposed to face upward when the tray support 6 is at the rotating end in the counterclockwise direction, but the first placement portion 71 of the tray 7 may be disposed to face upward when the tray support 6 is at the rotating end in the clockwise direction and the tray 7 may be reversed by rotating the tray support 6 in the counterclockwise direction.

According to the embodiment of the present invention as described above, the model toy and the cooking appliance toy 1 of the following aspect can be provided.

In a first aspect, there is provided a model toy including: a tray support configured to support a supported portion of a tray, the tray including a first placement portion and a second placement portion provided on an opposite side of the first placement portion; a housing which supports the tray support rotatably around a first axis, and which has an opening formed to oppose the tray support in a first axis direction; a door which is supported rotatably around a second axis with respect to the housing, and which is provided at the opening; and an operation unit configured to operate rotation of the tray support, wherein the door includes a main body and a regulated portion which are provided at symmetrical positions with respect to the second axis, and wherein when the tray support is in an intermediate angle range between a first angle posture and a second angle posture reversed from the first angle posture, at least part of the tray support is located closer to the regulated portion than that in the first angle posture and the second posture such that the tray support regulates an opening operation of the door and supports the door in a closed state.

According to the configuration, since the door 8 is not opened during the movement between the first angle posture and the second angle posture, the player can enjoy a change of a figure body disposed on the tray by finishing the operation of the operation unit 4 without visually recognize the reversing operation of the tray 7. Therefore, it is possible to easily enjoy the state change.

In a model toy according to a second aspect, the tray support includes a first support portion and a second support portion which extend in the first axis direction and are disposed at line symmetrical positions with respect to the first axis, and each of the first support portion and the second support portion has a groove portion formed on an inner side thereof and configured to accommodate the supported portion, and includes swing regulating protrusions provided on both outer sides of the groove portion and configured to regulate swing of the tray.

According to the configuration, since the tray support 6 appears substantially in the same appearance in both the first angle posture and the second angle posture as viewed from an opening 31 side where the door 8 is opened, it is possible to make it difficult for the player to recognize that the tray support 6 is rotated around the first axis. Therefore, only the figure body placed on the tray 7 can be seen as changed.

In a model toy according to a third aspect, each of the first support portion and the second support portion includes open state support portions formed on both outer sides of the groove portion to face in a direction opposite to the groove portion; when the tray support is in the first angle posture and the second angle posture, the open state support portion contacts the regulated portion such that an opening angle of the door is regulated, and the door is supported in an open state; when the tray support is in the first angle posture and the second angle posture, an inner surface of the door on an opening side and the open state support portion are located on a same plane; and a length from the supported portion to an end portion on a first placement portion side or second placement portion side of the tray is the same as a length from an inner wall of the groove portion to the open state support portion.

According to the configuration, the door 8 can be supported in the open state at a predetermined opening angle, and the tray 7 can be accommodated in the tray support 6 by a simple operation of placing the tray 7 on the inner surface 8*c* of the door 8 and sliding the tray 7 toward a tray support 6 side.

In a model toy according to a fourth aspect, each of the first placement portion and the second placement portion includes a bottom surface and a frame portion surrounding the bottom surface, and the bottom surface of the first placement portion allows a first figure body before change to be disposed thereon, and the bottom surface of the second placement portion allows a second figure body after change is fixed thereto.

According to the configuration, since the second figure body Fd2 after change is fixed to the tray 7 in advance, it is possible to simulate how the first figure body Fd1 before change is changed rapidly to the second figure body Fd2.

In a fifth aspect of the present invention, there is provided a cooking appliance toy including: a tray support configured to support a supported portion of a tray, the tray including a first placement portion and a second placement portion provided on an opposite side of the first placement portion; a housing which supports the tray support rotatably around a first axis, and which has an opening formed to oppose the tray support in a first axis direction; a door which is supported rotatably around a second axis with respect to the housing, and which is provided at the opening; and an operation unit configured to operate the rotation of the tray support, wherein the door includes a main body and a regulated portion which are provided at symmetrical positions with respect to the second axis, wherein when the tray support is in an intermediate angle range between a first angle posture and a second angle posture reversed from the first angle posture, at least part of the tray support is located closer to the regulated portion than that in the first angle posture and the second posture such that the tray support regulates an opening operation of the door and supports the door in a closed state, and a first figure body before cooking is disposed on the first placement portion, and a second figure body after cooking is disposed on the second placement portion.

According to the configuration, since the door 8 is not opened during movement between the first angle posture and the second angle posture, the player can enjoy a change due to cooking of a figure body (first figure body) disposed on the tray 7 by finishing the operation of the operation unit 4. Therefore, it is possible to easily enjoy the state change.

The embodiment of the present invention is as described above, but the present invention is not limited by the embodiment and hence can be modified variously.

For example, the frame portion 62 of the tray support 6 may have a shape in which the long side surface portions 62*a* on space S sides are cut out without being in a tubular shape. In this case, when the first figure body Fd1 before change is not fixed to the tray 7, the first figure body Fd1 falls downward due to the rotation of the tray support 6, for example, the lower frame portion 33 may be omitted, and the dropped first figure body Fd1 may be received by a receiving tray provided in the cooking appliance toy 1. The first figure body Fd1 can be easily collected by providing the receiving tray, for example, as a drawer under the second housing 3 such that the receiving tray can be inserted and removed.

In addition, the first figure body Fd1 and the second figure body Fd2 may be other shapes rather than food, and the cooking appliance toy 1 may be used as another model toy for enjoying the change of the figure body.

The invention claimed is:

1. A model toy comprising:

a tray support configured to support a supported portion of a tray, the tray comprising a first placement portion and a second placement portion provided on an opposite side of the first placement portion;

a housing which supports the tray support rotatably around a first axis, and which has an opening formed to oppose the tray support in a first axis direction;

a door which is supported rotatably around a second axis with respect to the housing, and which is provided at the opening; and an operation unit configured to operate rotation of the tray support, wherein the door comprises a main body and a regulated portion which are provided on opposite sides of the second axis, and wherein when the tray support is in an intermediate angle range between a first angle posture and a second angle posture reversed from the first angle posture, at least part of the tray support is located closer to the regulated portion than when the at least part of the tray support is in the first angle posture and the second angle posture such that the tray support regulates an opening operation of the door and supports the door in a closed state.

2. The model toy according to claim 1, wherein the tray support comprises a first support portion and a second support portion which extend in the first axis direction and are disposed at line symmetrical positions with respect to the first axis, and wherein each of the first support portion and the second support portion has a groove portion formed on an inner side thereof and configured to accommodate the supported portion, and comprises swing regulating protrusions provided on both outer sides of the groove portion and configured to regulate swing of the tray.

3. The model toy according to claim 2, wherein each of the first support portion and the second support portion comprises open state support portions formed on both outer sides of the groove portion to face in a direction opposite to the groove portion, wherein when the tray support is in the first angle posture and the second angle posture, the open state support portion contacts the regulated portion such that an opening angle of the door is regulated, and the door is supported in an open state, wherein when the tray support is in the first angle posture and the second angle posture, an inner surface of the door on an opening side and the open state support portion are located on a same plane, and a length from the supported portion to an end portion on a first placement portion side or second placement portion side of the tray is the same as a length from an inner wall of the groove portion to the open state support portion.

4. The model toy according to claim 1, wherein each of the first placement portion and the second placement portion comprises a bottom surface and a frame portion surrounding the bottom surface, and wherein the bottom surface of the first placement portion allows a first figure body depicting a first state before a change to be disposed thereon, and the bottom surface of the second placement portion allows a second figure body depicting a second state after the change to be disposed thereon is fixed thereto.

5. A cooking appliance toy comprising:

a tray support configured to support a supported portion of a tray, the tray comprising a first placement portion and a second placement portion provided on an opposite side of the first placement portion;

a housing which supports the tray support rotatably around a first axis, and which has an opening formed to oppose the tray support in a first axis direction;

a door which is supported rotatably around a second axis with respect to the housing, and which is provided at the opening; and an operation unit configured to operate the rotation of the tray support, wherein the door comprises a main body and a regulated portion which are provided on opposite sides of the second axis, wherein when the tray support is in an intermediate angle range between a first angle posture and a second angle posture reversed from the first angle posture, at least part of the tray support is located closer to the regulated portion than when the at least part of the tray support is in the first angle posture and the second angle posture such that the tray support regulates an opening operation of the door and supports the door in a closed state, and a first figure body depicting a before cooking state is disposed on the first placement portion, and a second figure body depicting an after cooking state is disposed on the second placement portion.

* * * * *